US007259723B2

(12) United States Patent
Himmelstoss et al.

(10) Patent No.: US 7,259,723 B2
(45) Date of Patent: Aug. 21, 2007

(54) DEVICE FOR EMITTING AND RECEIVING ELECTROMAGNETIC RADIATION

(75) Inventors: Armin Himmelstoss, Weissach Im Tal (DE); Klaus-Dieter Miosga, Backnang (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/503,859

(22) PCT Filed: Sep. 27, 2002

(86) PCT No.: PCT/DE02/03696

§ 371 (c)(1),
(2), (4) Date: Feb. 8, 2005

(87) PCT Pub. No.: WO03/067709

PCT Pub. Date: Aug. 14, 2003

(65) Prior Publication Data

US 2005/0128144 A1 Jun. 16, 2005

(30) Foreign Application Priority Data

Feb. 9, 2002 (DE) ..... 102 05 379

(51) Int. Cl.
*H01Q 19/06* (2006.01)

(52) U.S. Cl. ..... 343/753; 343/853; 343/700 MS

(58) Field of Classification Search ..... 343/753, 343/700 MS, 853, 754
See application file for complete search history.

(56) References Cited

U.S. PATENT DOCUMENTS

| | | | | |
|---|---|---|---|---|
| 5,041,840 | A | 8/1991 | Cipolla et al. | 343/725 |
| 6,107,955 | A * | 8/2000 | Wagner | 342/70 |
| 6,175,333 | B1 | 1/2001 | Smith et al. | 343/700 MS |
| 6,184,838 | B1 * | 2/2001 | Rao et al. | 343/753 |
| 6,246,375 | B1 * | 6/2001 | Yamada et al. | 343/754 |
| 6,366,245 | B1 * | 4/2002 | Schmidt et al. | 343/700 MS |
| 6,424,319 | B2 | 7/2002 | Ebling et al. | 343/911 L |

FOREIGN PATENT DOCUMENTS

| | | |
|---|---|---|
| DE | 197 19 764 | 11/1998 |
| DE | 197 31 085 | 1/1999 |
| EP | 0 831 551 | 3/1998 |
| EP | 1 162 689 | 12/2001 |
| JP | 60 018004 | 1/1985 |

OTHER PUBLICATIONS

Patent Abstracts of Japan vol. 009, No. 131 (E-319), Jun. 6, 1985.*

* cited by examiner

*Primary Examiner*—Tan Ho
(74) *Attorney, Agent, or Firm*—Kenyon & Kenyon LLP

(57) ABSTRACT

A device for transmitting and receiving electromagnetic radiation includes separate antennas for transmitting and for receiving electromagnetic radiation and in which the lobes of the transmitting and receiving antennas are focused by a shared focusing arrangement.

7 Claims, 3 Drawing Sheets

DEVICE FOR EMITTING AND RECEIVING ELECTROMAGNETIC RADIATION

This application is a 371 of PCT/DE 02/03696 filed on Sep. 27, 2002.

FIELD OF THE INVENTION

The present invention relates to a device for transmitting and receiving electromagnetic radiation, which includes separate antennas for transmitting and for receiving electromagnetic radiation and wherein the lobes of the transmitting and receiving antennas are focused by a common focusing arrangement.

BACKGROUND INFORMATION

German Published Patent Application No. 197 19 764 discusses a motor vehicle radar sensor that includes an antenna system which includes a focusing arrangement and at least two first antenna feeds that are arranged along a first straight line and form a first array of antenna feeds, in which is present at least one additional antenna feed which is arranged in such a manner that at least one additional array of antenna feeds is formed along an additional straight line, this additional array being capable of being laid out congruent to the first array by rotation about a hypothetical point of rotation M. This system provides a plurality of monostatic antenna feeds, each of which is used for transmitting as well as for receiving.

German Published Patent Application No. 197 31 085 discusses a device for transmitting and receiving radar waves, in particular for a range sensor. At least one antenna element is provided there, to which signals to be transmitted may be supplied and from which signals received may be picked up, the antennas being configured for the transmission of circularly polarized radar waves. The signals to be transmitted are supplied to at least one side of the antenna element in such a manner that they are radiated in a first plane of polarization. The signals received are picked up by the antenna at a second plane of polarization, which is orthogonal to the first plane of polarization. This system is also a monostatic transceiver system.

SUMMARY OF THE INVENTION

The present invention provides a device for transmitting and receiving electromagnetic radiation, in particular for use in the radar system of a motor vehicle, wherein as great as possible a part of the oscillator output may be emitted as transmission output, and wherein a high degree of discrimination with regard to detected objects is achieved and yet these conditions are obtainable using a compact configuration and simple structures.

The shared focusing arrangement, which focuses the lobes of the transmitting and receiving antennas, may be a dielectric lens. A dielectric lens of this kind is manufacturable compactly and inexpensively and is characterized by outstanding quality of beam convergence.

In addition, the antennas may be configured as patch antennas. Patch antennas are manufacturable to be very small and at a low cost, and have a good directional characteristic.

Additionally, each transmitting antenna may be assigned at least two receiving antennas. This may allow construction of a transceiver system that includes very simple conductor structures and may allow performance of angular resolution in the direction of the azimuth.

Each receiving antenna may be connected to a separate mixer, which receives a transmission signal which is tapped from the transmitting antenna feed by a line coupler. This configuration may allow mixers and line couplers to be made simply and at a low cost, whereby high signal quality is nevertheless obtained.

The receiving antennas may be arranged on a first straight line. This arrangement of the receiving antennas provides, in particular in such an assembly of the radar system, that this first straight line be positioned horizontally, permitting azimuth angle analysis. In particular, when this device is used in a motor vehicle radar system, it is of special interest to be able to assign an azimuth angle to the objects detected with the help of the electromagnetic radiation. When the device according to the present invention is used in this manner, it is of somewhat secondary importance to assign an angle of elevation to the detected objects.

In addition, the transmitting antennas may be arranged on a second straight line which is parallel to the first straight line on which the receiving antennas are arranged. In particular, in a symmetrical transmitting antenna feeding line structure the transmitting antennas emit the transmission output at the same points in time. Use of the device according to the present invention in a motor vehicle radar system makes it of special importance to assign an azimuth angle to the detected radar objects. Owing to this arrangement of the transmitting antennas, a detection range is obtained which is greater in horizontal than in vertical extension.

The first straight line, on which the receiving antennas are arranged, and the second straight line, on which the transmitting antennas are arranged, not be identical. This displacement of the straight lines on which the transmitting antennas are arranged, means that transmitting and receiving antennas lie as far apart as possible, owing to which direct interference from the transmitting antenna to the receiving antenna may be avoided. At the same time, it is possible to make the distance between the individual receiving antennas as great as possible, so that reliable phase analysis may be performed.

Two transmitting antennas and four receiving antennas may be provided. The lead from the oscillator to the transmitting antennas may be configured in such a manner that the same transmitting power may be supplied by a simple-to-make and readily controllable 3 dB power divider to each of the two transmitting antennas. In order to be able to perform reliable phase analysis of the electromagnetic radiation received, it may be desirable to provide more than three receiving antennas. The symmetrical configuration of the transmitting antennas in addition may make it desirable to provide an even number of receiving antennas. These two conditions are optimally met by four receiving antennas.

A first portion of the transmitting antennas may be arranged on a second straight line and a second portion of the transmitting antennas be arranged on a third straight line, the second straight line and the third straight line being parallel to the first straight line on which the receiving antennas are arranged and the second straight line and the third straight line being arranged at a like distance apart on either side of the first straight line. Owing to the symmetrical arrangement of the transmitting antennas in relation to the receiving antennas, a common directional diagram is obtained for the transmitting and receiving antennas, which is also symmetrical in the vertical direction, that is, perpendicularly to the straight lines on which the antennas are arranged. In this manner, "squinting" of the antennas in the vertical direction is avoided, since the error due to "squint" of the transmitting antennas on the second straight line and that of the transmitting antennas on the third straight line, which is produced with reference to the displaced receiving antennas, cancel each other out.

DETAILED DESCRIPTION

Figure 1:
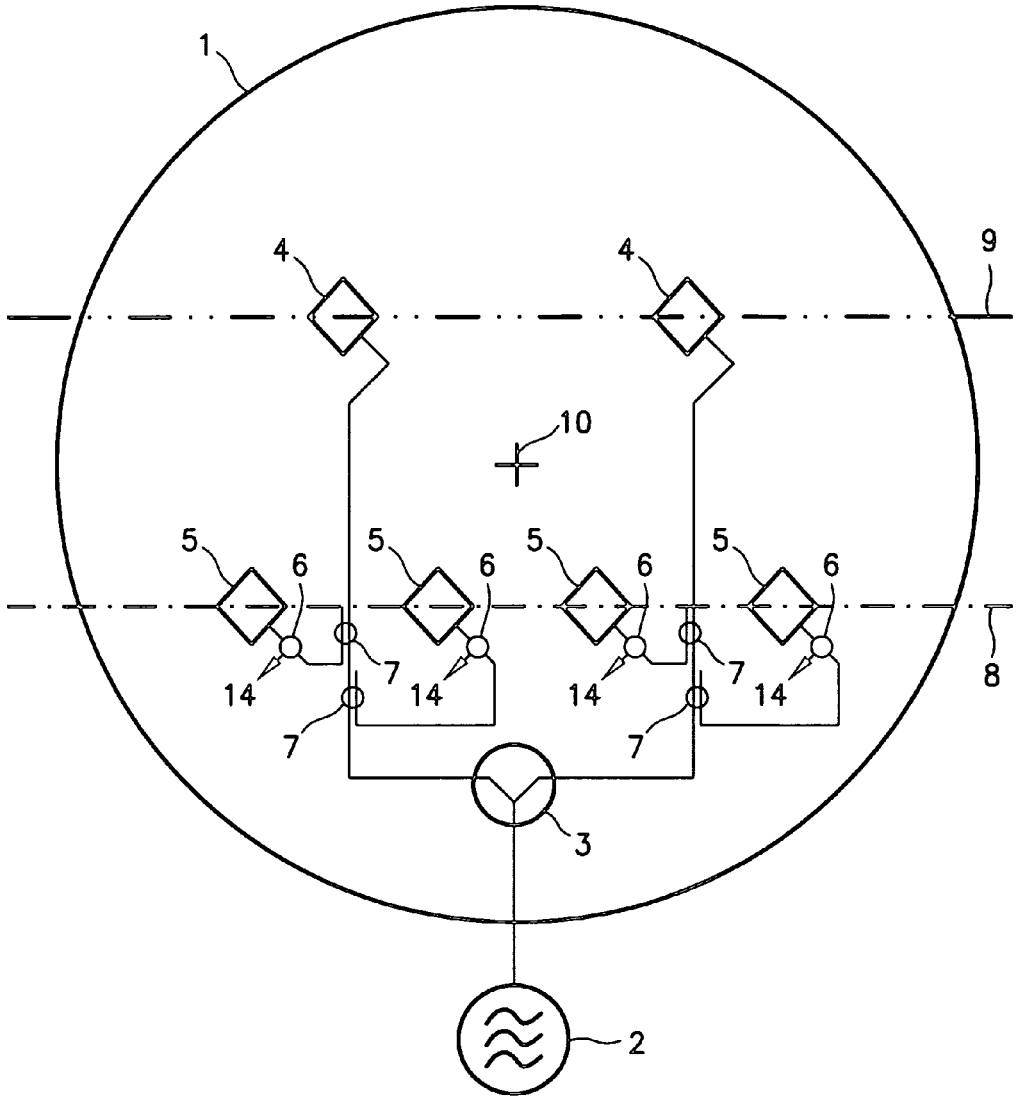
FIG. 1 shows a schematic front view of the device according to the present invention.

The front view of the device according to the present invention is illustrated in FIG. 1. Focusing arrangement 1, which in this exemplary embodiment is configured as a dielectric lens and is shown in circular shape, may be seen in FIG. 1. Behind this focusing arrangement is concealed the additional transceiver system, which is made up of antennas, lines and mixers. An oscillator 2 generates electrical signals, which are emitted via transmitting antennas 4. This oscillator 2 may be configured in a variety of variants. Thus, this oscillator 2 may generate for example a pulse signal or a continuous wave signal or may generate a frequency-modulated continuous-wave signal. Combinations of a variety of types of modulation are alternatively possible. The output signal of oscillator 2 is distributed in a power divider 3 to a plurality of transmitting leads. In this connection, it may be desirable that, if possible, the same signal amplitude be supplied to the various transmitting leads, so that individual antennas 4 also if possible emit at the same signal powers. The outputs of power divider 3, which in this example is configured as a 3-dB power divider, are conducted via transmitting antenna feeding lines to transmitting antennas 4.

In the exemplary embodiment illustrated, these transmitting antennas are arranged on a common straight line 9, which in FIG. 1 is shown as a double-dotted line. Receiving antennas are arranged on an additional straight line 8, which in FIG. 1 is shown as a single-dotted line and which is arranged parallel to straight line 9. Transmitting antennas 4 and receiving antennas 5 may be configured as patch antennas. FIG. 1 shows an arrangement of transmitting antennas 4 and receiving antennas 5 on two different straight lines 8 and 9, thus resulting in considerable space saving. The electromagnetic radiation that is received by receiving antennas 5 is in each instance emitted at the antenna output to a mixer 6. This mixer 6 is configured in strip transmission line technology, owing to which it is inexpensive to produce. Receiving mixers 6 in addition receive an input signal, which corresponds to the transmitting signal that is supplied to transmitting antennas 4. For this purpose, line couplers 7 are arranged on the transmitting antenna feeding line, which tap some of the transmitting power and supply it to receiving mixers 6. In receiving mixers 6 the transmitter signal, which corresponds to the output signal of oscillator 2, is mixed with the output signal of receiving antennas 5, as a result of which an intermediate-frequency signal is generated. This intermediate-frequency signal is picked up at the output of receiving mixer 6 and supplied for further processing to a signal-processing arrangement 14, which is not shown in the figures.

Figure 2:
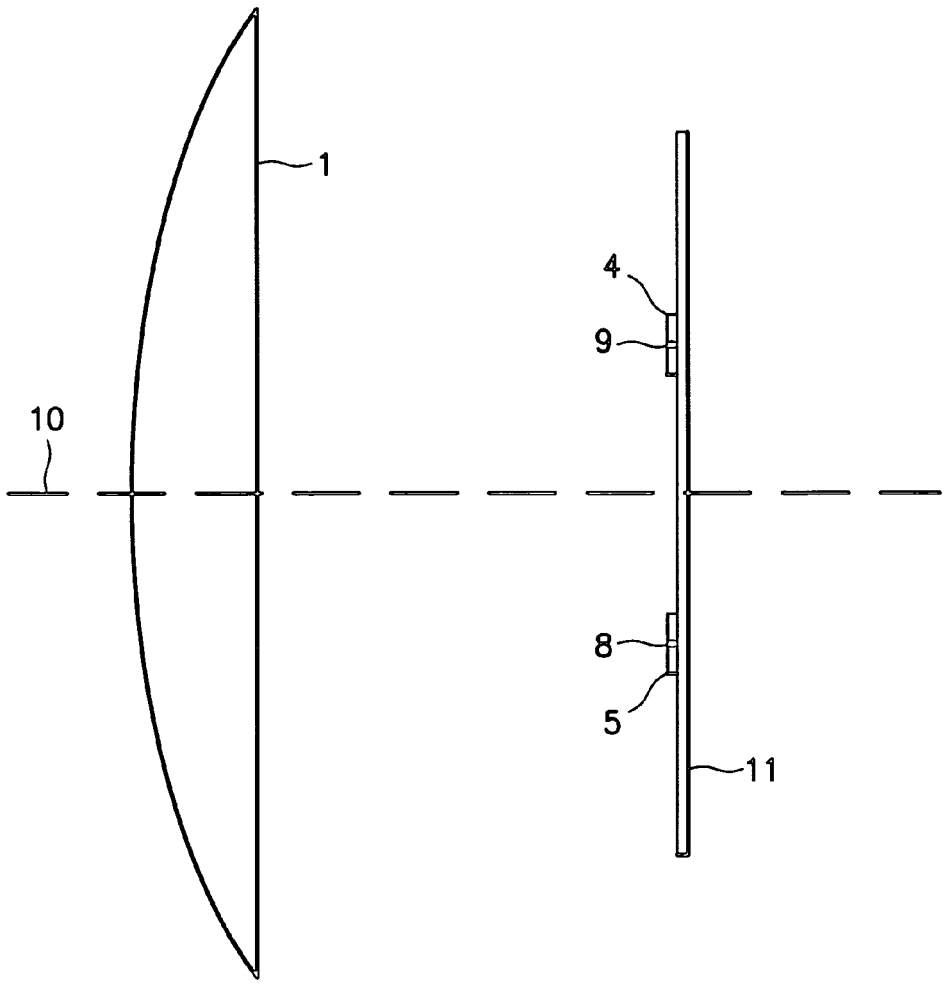
FIG. 2 shows a side view of the device according to the present invention.

A side view of the device is shown in FIG. 2. This side view represents the same object from a different perspective than that described in FIG. 1. Focusing arrangement 1, which in the exemplary embodiment described is configured as a dielectric lens, may again be seen in FIG. 2. The axis of symmetry of focusing arrangement 1, which at the same time forms the optical axis of focusing arrangement 1, is represented by straight line 10. Behind focusing arrangement 1 an antenna support is arranged at a distance of approximately the focal distance of focusing arrangement 1. This antenna support may be a printed circuit board, which, in addition to transmitting and receiving antennas 4, 5, supports additional circuit elements such as for example mixers 6, line couplers 7, power divider 3 and antenna leads. For purposes of simplification, only transmitting antenna 4 and receiving antenna 5 on antenna support 11 have been shown in FIG. 2. In addition, two straight lines 8, 9, along which receiving antennas 5 and transmitting antennas 4 are arranged, may be seen in FIG. 2.

Figure 3:
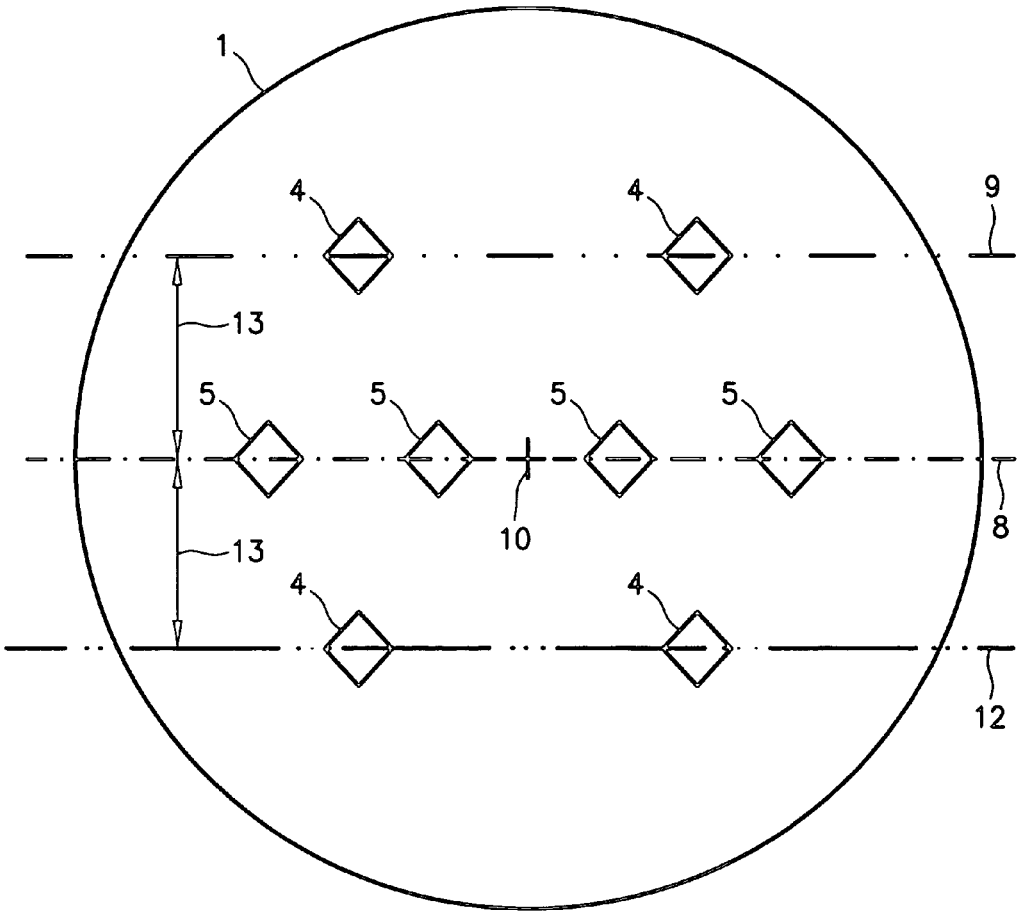
FIG. 3 shows an additional schematic front view of the device according to the present invention.

An additional exemplary embodiment, wherein receiving antennas 5 are arranged on a common first straight line 8, is illustrated in FIG. 3. Since in the exemplary embodiment of FIG. 1 the directional diagram of transmitting antennas 4 and that of receiving antennas 5 are not exactly aligned to one another in the vertical direction due to the displacement of the first and the second straight lines 8, squinting of the antenna system develops because the main directions of radiation of the transmitting and receiving characteristics are easily shifted. However, since horizontal angle resolutions are to be measured by the present invention, this is of secondary importance. The system of FIG. 3 also prevents this squinting. For this purpose, the receiving antennas are arranged on the first straight line 8. On approximately a second straight line 9, which is represented as a double-dotted line in FIG. 3 and which runs parallel to the first, single-dotted straight line 8, a first portion of transmitting antennas 4 is arranged. A second portion of transmitting antennas 4 is arranged on a third straight line 12, which is represented as a triple-dotted line in FIG. 3. This third straight line 12 is aligned parallel to the first straight line 8 and is arranged at the same distance 13 from the first straight line 8 as the second straight line 9 is from the first straight line 8. As a result, the first portion of transmitting antennas 4 on the second straight line 8 squints in exactly the opposite direction of the second portion of transmitting antennas 4 on third straight line 12. The common directional characteristic of all transmitting antennas 4 is nevertheless aligned exactly with the directional characteristic of the receiving antennas, so the two partial errors, which point in opposite directions, are evened out and the errors due to the squint of the first and second portions of transmitting antennas 4 cancel each other out. The leads of antennas 4 and 5, mixers 6, as well as line couplers 7 and power divider 3 are of course also provided in this exemplary embodiment in a manner similar to that of FIG. 1, but their representation has been omitted in FIG. 3 for purposes of clarity.

The device according to the present invention, which includes focusing arrangement 1 as well as the antenna system shown which is mounted on an antenna support or a printed circuit board 11, is accommodated in a housing that at the same time secures the individual parts of the device. In addition, a device for signal processing 14, which further processes the intermediate-frequency signals of the outputs of mixers 6 and is for example used in a motor vehicle for operation of an adaptive cruise control, is provided in this housing.

What is claimed is:

1. A device for transmitting and receiving electromagnetic radiation, comprising:

antennas for transmitting and receiving electromagnetic radiation; and a focusing arrangement to focus lobes of the antennas;

wherein the antennas include transmitting antennas and each of the transmitting antennas is assigned at least two receiving antennas, and wherein the focusing arrangement includes a dielectric lens.

2. A device for transmitting and receiving electromagnetic radiation, comprising:

antennas for transmitting and receiving electromagnetic radiation; and a focusing arrangement to focus lobes of the antennas;

wherein the antennas include transmitting antennas and each of the transmitting antennas is assigned at least two receiving antennas, and wherein the antennas include patch antennas.

3. A device for transmitting and receiving electromagnetic radiation, comprising:

antennas for transmitting and receiving electromagnetic radiation; and a focusing arrangement to focus lobes of the antennas;

wherein the antennas include transmitting antennas and each of the transmitting antennas is assigned at least two receiving antennas, and wherein each of the receiving antennas is connected to a separate mixer to which a transmission signal is supplied which is extracted from a transmitting antenna feeding line by a line coupler.

4. A device for transmitting and receiving electromagnetic radiation, comprising:

antennas for transmitting and receiving electromagnetic radiation; and a focusing arrangement to focus lobes of the antennas;

wherein the antennas include transmitting antennas and each of the transmitting antennas is assigned at least two receiving antennas, and wherein the receiving antennas are arranged essentially on a first straight line.

5. The device of claim 4, wherein transmitting antennas are arranged essentially on a second straight line, which is parallel to the first straight line on which the receiving antennas are located.

6. The device of claim 5, wherein the first straight line, on which the receiving antennas are arranged, and the second straight line, on which the transmitting antennas are arranged, are not identical.

7. The device of claim 4, wherein a first portion of the transmitting antennas is arranged on a second straight line and a second portion of the transmitting antennas is arranged on a third straight line, the second straight line and the third straight line being arranged parallel to the first straight line on which the receiving antennas are arranged, and the second straight line and the third straight line being arranged at a same distance on either side of the first straight line.

* * * * *